US005412969A

United States Patent [19]

Bertholon

[11] Patent Number: 5,412,969

[45] Date of Patent: May 9, 1995

[54] ROLL REPLACEMENT INSTALLATION

[75] Inventor: Gérard Bertholon, Saint-Etienne, France

[73] Assignee: Clecim, France

[21] Appl. No.: 77,079

[22] Filed: Jun. 16, 1993

[30] Foreign Application Priority Data

Jun. 16, 1992 [FR] France ..... 92 07289

[51] Int. Cl.[6] ..... B21B 31/10

[52] U.S. Cl. ..... 72/239

[58] Field of Search ..... 72/238, 239

[56] References Cited

U.S. PATENT DOCUMENTS

| | | | |
|---|---|---|---|
| 3,396,566 | 8/1968 | Alsop et al. | 72/239 |
| 3,491,570 | 1/1970 | Beard | 72/239 |
| 4,771,626 | 9/1988 | Ichida et al. | 72/239 |

FOREIGN PATENT DOCUMENTS

| | | | |
|---|---|---|---|
| 0112981 | 7/1984 | European Pat. Off. . | |
| 0154208 | 11/1981 | Japan | 72/239 |
| 61-286008 | 12/1986 | Japan . | |
| 63-157708 | 6/1988 | Japan . | |
| 2037637 | 7/1980 | United Kingdom | 72/239 |
| 2226265 | 6/1990 | United Kingdom . | |
| 1196068 | 12/1985 | U.S.S.R. | 72/239 |

*Primary Examiner*—Lowell A. Larson
*Assistant Examiner*—Thomas C. Schoeffler
*Attorney, Agent, or Firm*—Pollock Vande Sande & Priddy

[57] ABSTRACT

An installation for replacing live rolls in a rolling mill, comprising a drum which rotates about an axis parallel to the axes of the rolls in the tightening plane passing through these axes. The drum comprises at least two compartments, each symmetrical with respect to a median plane passing through the axis of rotation, and which can be placed, alternately, by rotating the drum, in a roll replacement position in front of the working zone of the mill stand. Each compartment has two pairs of guide rails which, in the roll replacement position of the corresponding compartment, are aligned, respectively, with two pairs of fixed rails in the stand. One of the compartments is vacant, while each of the other compartments holds in store a pair of live rolls, which have chocks bearing on the corresponding rails of the compartment. The drum is associated with a mechanism for transferring live rolls into the vacant compartment of the drum and replacement rolls into the working position in the stand.

21 Claims, 8 Drawing Sheets

II

II
27
50
53
55
26
51
56
5
24
58
23
31a
3
4'a
4a
20
2
31
21
57
25
52
15
31b
15'
14
13
41
41'
11
1
12
4
16
40
12'
13'
4'
40'
14

ROLL REPLACEMENT INSTALLATION

BACKGROUND OF THE INVENTION

1. Field of the Invention

This invention relates to an installation for replacing live rolls in a mill stand and, in particular, in a skin-pass stand.

2. Background of the Invention

As is known, a rolling mill generally comprises at least two superposed rolls inside a fixed stand, the axes of the rolls being parallel and located in a substantially vertical plane. "Two-high" stands, for example, comprise only two rolls, with the product to be rolled passing between them. In "Four-high" stands, the product to be rolled passes between two live rolls of relatively small diameter which bear directly on two pressure rolls. In "Six high" stands, the corresponding pressure roll. Other types of rolling mil comprising a greater number of rolls are also known The main purpose off "skin-pass" rolling mills is not to reduce the thickness of the product, but only to modify the surface state or metallurgical properties of an already rolled strip. A skin-pass stand is generally made up in the same way as a four-high stand, with two live rolls surrounded by two pressure rolls.

The live rolls, which are in contact with the product, wear relatively quickly.. It must also be possible to adapt the diameter of these live rolls to the nature and thickness of the product to be rolled and, in certain cases, to the surface state required. The rolls must therefore be periodically replaced.

It is also known that the mill rolls must be driven in rotation and that the driving torque may be applied either directly on to a live roll or on to one of the pressure rolls which then drives the corresponding live roll in rotation by friction. Each mill stand is therefore associated with drive means connected to the driven roll by a spindle having universal joints at its ends. This is why the roll replacement device is generally placed on the operator side, i.e., on the side opposite the drive means.

Various arrangements have been used up until now to replace live rolls.

Generally, each end off each roll turns in a chock which forms a centering fork for the roll, and on which forces can be applied to tighten or strain the roll. To be able to remove and introduce the rolls together with their chocks, the chocks often are provided with rollers that roll on rails provided on the fixed uprights of the sand and parallel to the axes of the rolls.

To withdraw a roll of to place it back in position, a balanced "C-shaped" hanging device can be used, for example, carried by a traveling crane, and which comprises a part that penetrates into the axis of the roll in order to lock onto it.

In another arrangement, described in document JP-A-61.286.008, use is made of a magazine arranged next to the stand, mounted so as to rotate about an axis parallel to the axes of the rolls and comprises a number of compartments in which replacement rolls are stored, one of these compartments being empty.

The magazine is first of all rotated about its axis until the empty compartment is aligned with the roll to be replaced in its working position in the stand. A transfer means associated with the magazine then locks onto one end of the roll to be replaced, withdraws it from the stand and places it in the empty compartment.

The magazine is then rotated about its axis until a replacement roll stored in another compartment is aligned with the working position. The transfer means then pushes the replacement roll into its working position on the stand.

In the case of a skin-pass stand, such roll changes are called for relatively frequently, so that rolls can be taken to the workshop for reconditioning or placed in store temporarily and replaced by other rolls according to program changes, for example in order to obtain another state of roughness on the strip or change the diameter of the rolls.

In addition, the current practice is to make metal strip processing lines operate continuously, consisting in particular of one or more skin-pass stands using strip accumulators which make it possible to intervene on one part of the installation for the purposes of a repair or a replacement without stopping the feeding of the strip through the other parts.

However, these accumulators have only a limited capacity, which means that it is important to keep the intervention time as short as possible.

In a rolling mill installation comprising several stands placed sequentially in the product feed direction, it would be attractive to use a mobile roll replacement device comprising a roll support platform, placed at the desired height, and capable of moving on rails parallel to the feed direction along one side of the stands so as to take up position in front of one of these stands.

In an arrangement of this type described, for example, in GB-A-2.226.265, the two live rolls placed inside the stand form a superposed assembly which, through roll lets provided on the chocks of the lower roll, rolls on two rails fixed to the stand and parallel to the axes of the rolls. This stand is also associated with an auxiliary bench placed on the other side of the rolling track of the roll replacement device. This auxiliary bench carries two rails on which a pair of superposed reserve rolls are mounted in the manner described above.

The roll replacement device comprises a platform which turns about a vertical axis, and on which two pairs of parallel rails are provided, arranged symmetrically on each side of the axis. In the replacement position, these rails are aligned, respectively, with the fixed rails of the stand and the fixed rails of the bench, the latter being longitudinally offset with respect to the stand.

Two transfer means, rolling in opposite directions, respectively, on the two pairs of rails of the rotary platform, make it possible to bring the rolls to be replaced which are withdrawn from the stand and the replacement rolls which are withdrawn from the auxiliary bench, onto the rotary platform at the same time. A 180° rotation of the platform makes it possible to reverse the arrangement and, by moving transfer means in the opposite direction, to introduce the replacement rolls into the stand and move the worn rolls previously withdrawn from the stand onto the bench.

Although rolls can be rapidly replaced using such an arrangement, the pair of replacement rolls has to be selected in advance and placed on each stand's auxiliary bench. The assembly is therefore very bulky and makes the mill stands difficult to access, the device being placed, as customary, on the operator side.

Moreover, several roll handling operations are involved, with each pair of used rolls having to be transported to a maintenance and storage zone and then replaced by new rolls.

Even if such a device is used, the worn rolls have to be picked up again and deposited in a maintenance and storage zone from where new rolls are taken and ]laced on the auxiliary bench.

These handling operations are time consuming and expose the rolls to risks of accidental damage as they are moved.

Skin-pass rolling mills, where live rolls have to be changed relatively often in line with manufacturing programs, require many such handling operations.

The invention offers a solution to all these drawbacks I 0 thanks to a new mill roll replacement installation designed to reduce the number of handling operations, and as a result reduces the risk of rolls becoming damaged, and which also gives a wider choice of replacement rolls.

In addition, the invention makes it possible to replace rolls in a very short space of time and without stopping the feeding of the rolled strip.

SUMMARY OF THE INVENTION

The invention relates to a roll replacement installation in a rolling mill comprising at least four superposed rolls inside a fixed stand, respectively two live rolls, placed in a working zone of the stand and bearing on at least two pressure rolls, each live roll having two ends carried respectively by chocks symmetrical with respect to a tightening plane passing through the axes of the live rolls. The chocks each have guiding parts which slide, respectively, on two pairs of fixed guide rails extending parallel to the axes of the rolls and provided on the stand on each side of the tightening plane for the removal of said live rolls by a sliding axial movement.

In accordance with the invention, the roll replacement installation comprises:

a drum carried by a chassis arranged on one side of the stand, the drum being mounted so as to rotate about an axis located in the tightening plane and parallel to the axes of the rolls, and comprising at least two compartments each symmetrical with respect to a median plane passing through the axis of rotation, means for the rotation control of the drum about its axis in order to successively place each compartment of the drum in a roll replacement position in front of the working zone on the stand, the median plane of the compartment coinciding with the tightening plane, two pairs of guide rails inside each compartment arranged symmetrically with respect to the compartment's median plane of the compartment, the rails being in alignment with, respectively, the two pairs of fixed rails of the stand, in the roll replacement position of the corresponding compartment, at least one of the compartments being empty and each of the others containing a pair of reserve live rolls with chocks bearing on the corresponding rails of the compartment, the rails being associated with means for holding the pair of rolls in position inside the compartment in any angular position of the drum, and means for transferring the pair of live rolls rotated in the stand by an axial sliding movement to the empty compartment placed in alignment with the working zone and, inversely, a pair of reserve rolls from the corresponding compartment of the drum to the working position in the stand, the said compartment being brought into alignment with the working zone by rotating the drum.

According to a particularly advantageous embodiment of the invention, the drum is mounted in movable fashion on the chassis of the roll replacement device, the latter comprising a platform carrying at least two pairs of rollers spaced symmetrically with respect to each other and each side of a vertical median plane of the platform which, in the roll replacement position, coincides with the tightening plane P of the stand, the drum having, on its periphery, at least two circular tracks centered on its axis of rotation and which rest, respectively, on the said pairs of rollers.

According to a further, particularly advantageous embodiment of the invention, such a drum can be placed as desired on the side of the operator, the drive side, or on both sides of the stand.

When the drum is placed on the operator side, it is carried, preferably, by a carriage rolling on rails and associated with a means of moving the carriage between a first roll replacement position attached to the stand and a second position away from the stand.

Conversely, when the drum is placed on the drive side, it is preferably carried by a fixed chassis passing above the drive means, for example a drive spindle, of the lower pressure roll.

However, in a simplified embodiment, such a fixed chassis could also carry simply one compartment similar to that of the drum, such compartment being fitted with two pairs of rails placed respectively in alignment with the fixed rails of the stand. Such a compartment constitutes an auxiliary support which can either be left empty ready to accept the pair of rolls to be replaced pushed out of the stand by the replacement rolls pushed out, of the drum, or to store replacement rolls which, on transfer into the working position, push the rolls to be replaced into an empty compartment in the drum.

In the case of a rolling installation comprising several stands arranged in sequence along the feed direction of the product to be rolled, the rails on which the carriage rolls extend parallel to the feed direction, so that the replacement carriage can serve all the stands.

However, even for installations comprising a single stand, it is desirable to be able to distance the roll replacement device from the stand, the former being made up of a carriage rolling on rails parallel to the axes of the rolls.

Preferably, the distanced position of the roll replacement device corresponds to the point where the rolling rails cross a transverse rolling track on which a loading carriage can move carrying at least one pair of replacement rolls, the crossing point comprising a turntable on which the roll replacement device is placed so as to be brought into alignment with the loading carriage for the transfer of replacement rolls from the carriage to a vacant compartment in the drum and, inversely, worn rolls from the drum to the loading carriage.

In a preferred embodiment, the drum contains three compartments, each one capable of holding pair of rolls. These compartments are centered respectively on three planes passing through the axis of rotation and spaced from each other by 120°.

In a particularly advantageous fashion, in the case where the roll replacement device is placed on the drive side, the drum comprises a free axial space between the storage compartments for the passage of a means controlling the driving of an upper pressure roll.

According to another advantageous embodiment, the transfer means are mounted on the drum support chassis and comprise a supporting part which can be rigidly locked in removable fashion to each pair of rolls in at least one direction of movement, and means for controlling the alternate movement of the supporting part parallel to the axes of the rolls between a position where it locks on to the pair of rolls in the drum, and a position where it deposits the pair of rolls in the stand, and inversely.

In a first embodiment, the installation comprises one roll replacement device located on only one side of the stand, and is equipped with transfer means which, in one direction, withdraw the rolls to be replaced from the stand and transfer them into a vacant compartment in the drum, and in the other direction transfer replacement rolls from the drum to the working position in the stand.

In another embodiment, the installation may comprise at least two storage drums placed respectively each side of the stand, at least one of the drums having a vacant compartment ready to accept the pair of rolls to be replaced after its removal from the stand.

To facilitate the loading of new rolls and the withdrawal of worn rolls, each storage compartment can be placed, by rotating the drum, in a loading position for which the storage compartment centered in the vertical median plane of the drum is placed above the axis, and can open upwardly to allow a pair of rolls to be withdrawn and/or introduced by means of a handling device, the drum comprising movable means for closing each compartment and locking the pair of rolls in position after it has been introduced into the compartment.

BRIEF DESCRIPTION OF THE DRAWINGS

The invention will be better understood from the following detailed description of a number of particular embodiments of the invention given by way of example, and illustrated in the accompanying drawings in which.

DESCRIPTION OF THE PREFERRED EMBODIMENTS

Figure 1:
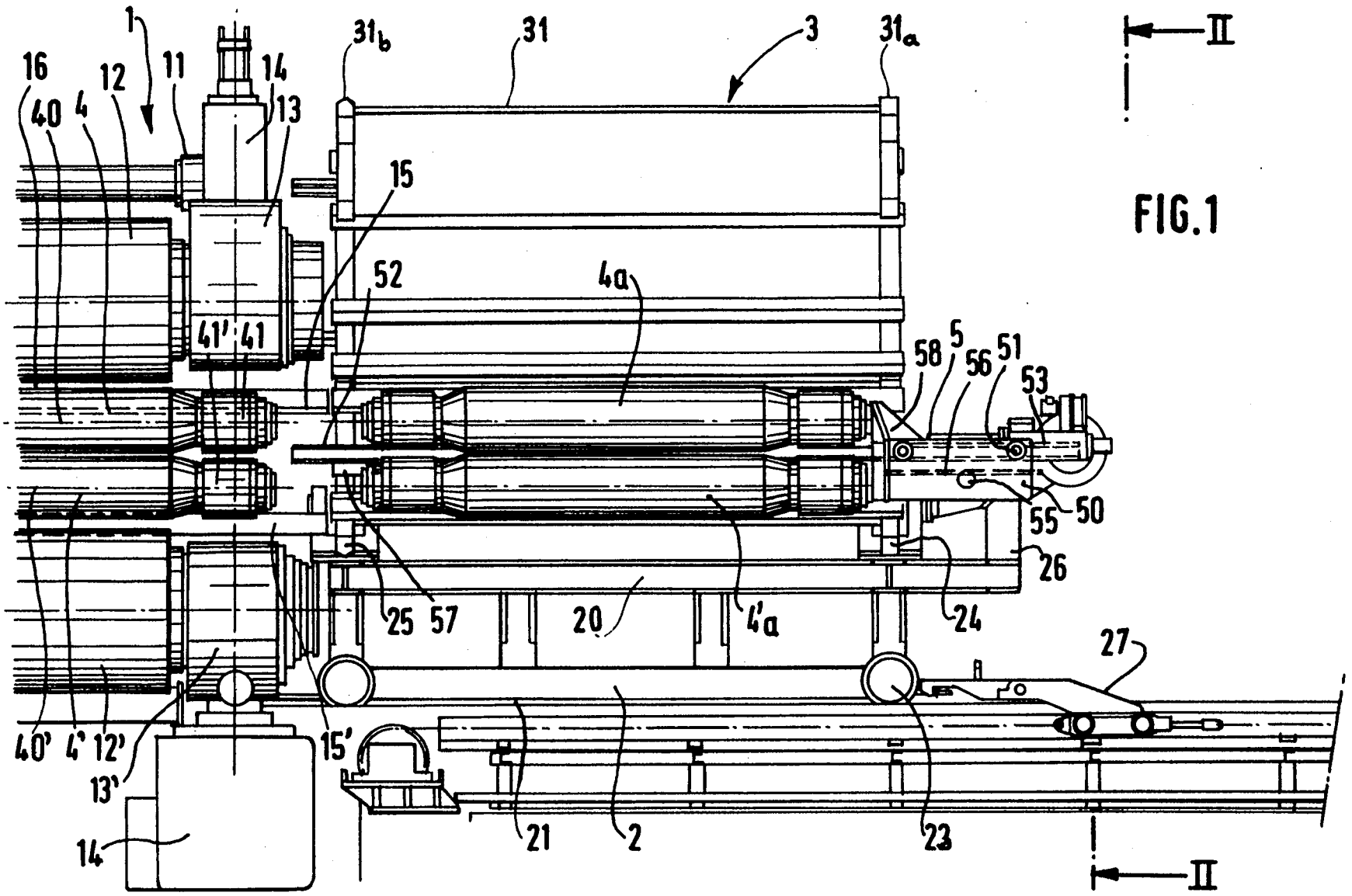
FIG. 1 is a longitudinal cross-sectional view of a roll replacement device associated with a mill stand.

FIG. 1 shows a partial view of a skin-pass mill stand 1 associated with a roll replacement device comprising a chassis 2 carrying a storage means 3 placed on the "operator" side of the stand, and rotational drive means placed on the opposite side.

The mill stand 1, of which only half is shown in FIG. 1, comprises, as is customary, a fixed frame comprising two parallel vertical elements 11 between which is mounted a set of four rolls, respectively two live rolls 4, 4', surrounded by two pressure rolls 12, 12', this set being symmetrically arranged with respect to a tightening plane P passing through the axes of live rolls 4, 4'.

Pressure rolls 12, 12', are supported at their ends by chocks 13, 13' to which clamping forces can be applied in a conventional way by means of a clamping device 14.

Live rolls 4, 4', also have chocks 41, 41' at their ends. These chocks may be associated in a conventional way with cambering means (not shown).

Chocks 13, 13' of pressure rolls 12, 12', and chocks 41, 41', of live rolls 4, 4', are placed in ports provided in vertical elements 11. These ports comprise parallel flat faces for guiding the chocks parallel to the vertical tightening plane P.

All these arrangements are well known and need not therefore be described in detail.

The two live rolls 4, 4' can be introduced or withdrawn either individually or together by sliding them, respectively, along two pairs of guide rails 15, 15', fixed, respectively, to the sides of the ports of each vertical element 11, parallel to the axes of the rolls, and on which chocks 41, 41' bear by means of corresponding supporting parts such as sliding surfaces or runners.

Rolls 4, 4', can thus be placed on a roll replacement device 2 arranged next to the stand, preferably on the operator side. A corresponding side view is shown in FIG. 1 and a cross-section in FIGS. 2 and 3.

According to the invention, the roll replacement device 2 is fitted with a mobile storage means consisting of a drum 3 mounted so as to rotate on chassis 20 of roll replacement device 2 about a horizontal axis 30 which is located in the vertical median plane of chassis 20 and which coincides with the tightening plane P of stand. 1.

Preferably, drum 3 is removable and simply rested on chassis 20. The upper part of chassis 20 forms a platform 22 which is fitted with two pairs of spaced rollers 24, 24', 25, 25', spaced symmetrically each side of the median plane P and on which drum 3 rests by means of two circular tracks 31*a*, 1*b* b centered on the axis of rotation 30. Preferably, at least one of the tracks 31*b* has a V-shaped cross-section and the corresponding rollers 25, 25' have a conjugate shape to ensure the longitudinal holding of drum 3.

Figure 2:
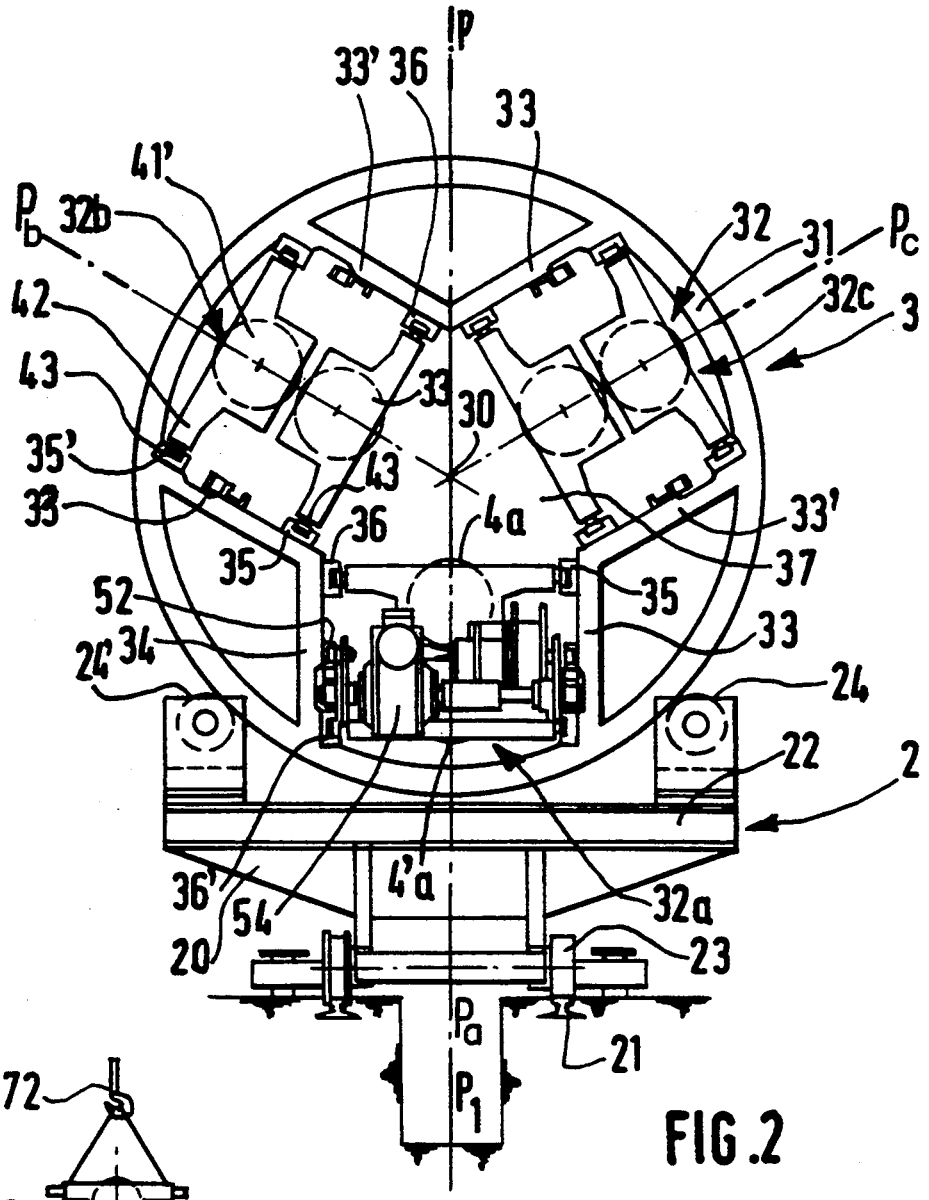
FIG. 2 is a front view of the device along the line II—II in FIG. 1.
Figure 9:
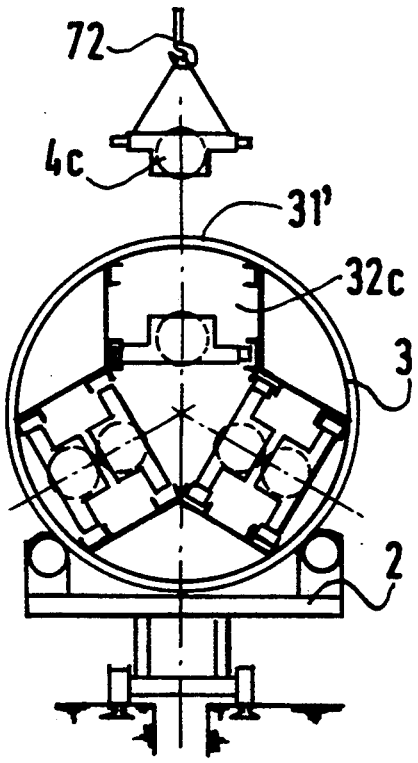
FIG. 9 shows a loading method according to an alternative embodiment.
Figure 3:
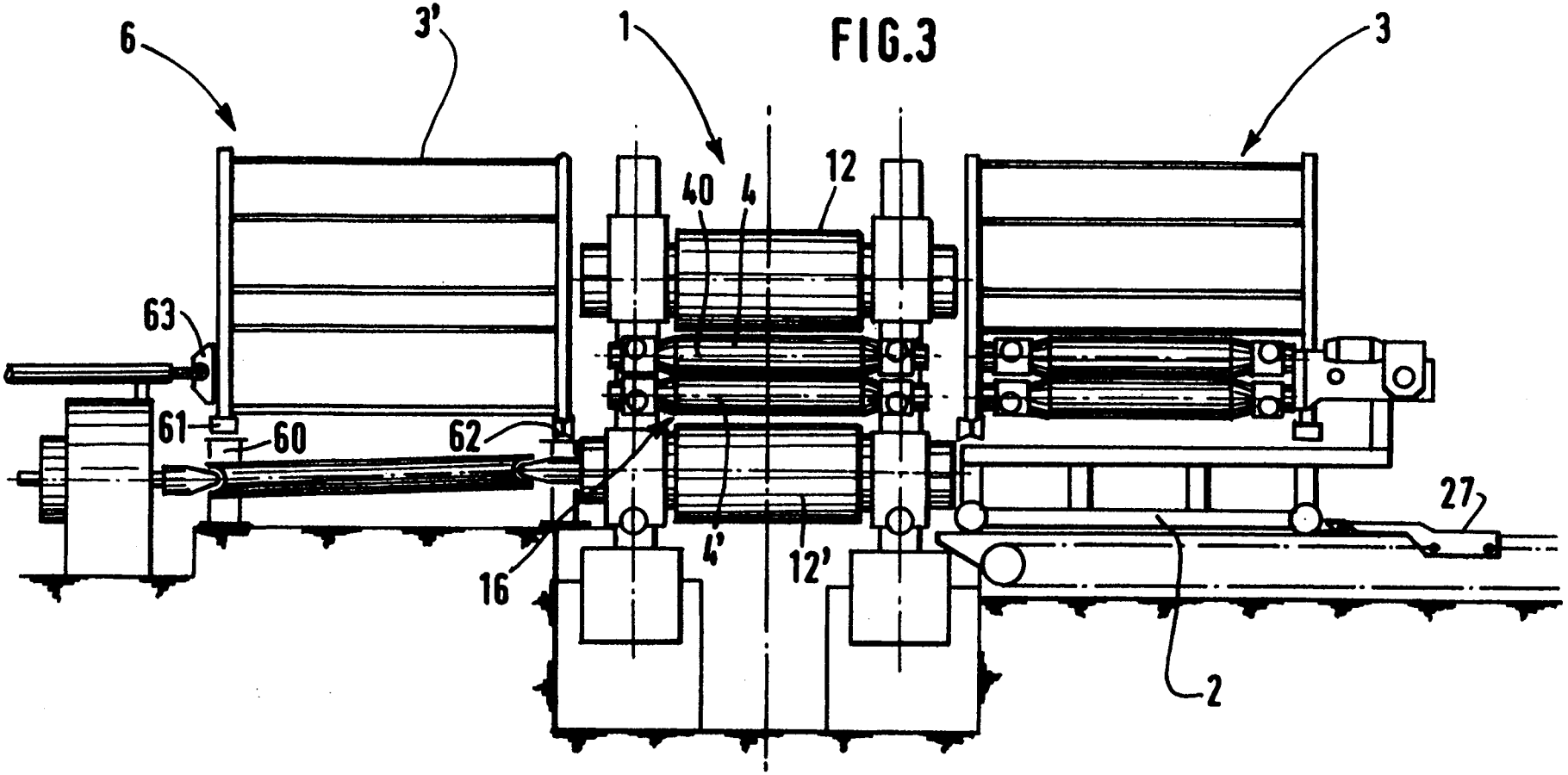
FIG. 3 is a longitudinal cross-sectional view of a complete installation equipped with two storage drums.

Drum 3, which constitutes the live roll storage device, comprises, as shown in FIGS. 2 and 3, a cylindrical wall 31 inside of which are preferably provided three compartments 32*a*, 32*b*, 32*c*, centered respectively on three planes P*a*, P*b*, P*c* passing through axis 30, and mutually spaced by 120° such that the three compartments 32*a*, 32*b*, 32*c* are regularly distributed about axis 30.

Each compartment 32 is limited by two partitions 33, 33' parallel to its median plane P*a* (P*b*, P*c*).

In order not to encumber the stand on the operator side, chassis 20 carrying drum 3 advantageously consists of a carriage resting on rollers 23 rolling on rails 21 parallel to the axes of the rolls, allowing it to be moved between a roll replacement position, close to mill stand 1, and a position further away where the mill stand is well clear of the operator side.

This movement can be performed, for example, by a device 27 comprising a hook fixed to a looped chain 28 driven alternately in opposite directions so as to move carriage 2 along rails 21.

Means simple to design allow drum 3 to be rotated about its axis in order to bring each compartment 32*a*, 32*b*, 32*c* in turn into the roll replacement position in alignment with the live rolls, the median plane P*a* (P*b*, Pc) of each compartment then being in alignment with the tightening plane P. It is possible, for example, to act on supporting rollers 24, 25 or alternatively use a rotating drive pinion meshing with a crown gear integral with the drum.

In conventional fashion, chocks 41, 41' of live rolls 4, 4' have lugs 42 fitted with rollers 43 which roll on rails 15 of stand 1 in order to introduce or withdraw the pair of rolls 4, 4'.

In similar fashion, each compartment 32 is fitted with two pairs of rails 35, 36 (35', 36') fitted respectively on the two partitions 33, 34. The said rails define two sliding planes parallel to axis 30, the distance between them corresponding to the distance between rollers 43, 43' of chocks 41, 41' such that each compartment 32 is able to contain two superposed live rolls 4, 4', the chocks 41, 41' of which are carried, respectively, by two pairs of rails 35, 36, (35', 36').

Note, however, that the purpose of rails 35, 36 is not only to allow the chocks to slide but also to hold them inside the compartment irrespective of the orientation of the latter. For example, as shown in the drawings, rails 35, 36 can be made up of U-shaped parts inside of which rollers 43 are inserted with exactly the amount of play necessary to ensure sliding.

A stop device, for example an electronically controlled brake or hydraulically or pneumatically controlled retractable end stop, is used to stop the drum in the precise position where rails 15 of the stand are aligned with rails 35, 36 of the selected compartment. Such a device is easy to design and is not shown in the figures.

The dimensions of drum 3 and the positions of the supporting rollers 24, 24' on carriage 2 are so chosen that the lowest compartment 32*a*, whose median plane P1 is vertical, faces live rolls 4, 4' located in the working position in stand 1, rails 35, 36 (35', 36') now being located in the prolongation of fixed rails 15 of stand 1.

Thus, when the drum is located in the position shown in FIG. 2, the two rolls 4*a*, 4'*a* placed in compartment 32*a* are centered on the axes 40, 40' of live rolls 4, 4' in place in the working zone 16 of stand 1. After the live rolls 4, 4' have been withdrawn, rolls 4*a*, 4'*a* are moved axially into stand 1 into the service position by rolling successively on rails 35, 36, 35', 36' of drum 3 and rails 15, 15' of stand 1, which are aligned.

It is thus possible, by axially moving rolls, either to withdraw in-service rolls 4, 4' from the stand 1 and introduce them into a vacant compartment in drum 3, or to push into the service position in the stand a pair off rolls 4*a*, 4'*a* stored in one of the compartments, for example 32*a*, of drum 3.

The axial movement of the live rolls can be performed by means of a transfer means 5 mounted on carriage 2.

In the arrangement shown in the drawings, transfer means 5 is self-driven and comprises a carriage 50 which can roll by means of rollers 51 on rails 52 provided on each partition 33, 34 in compartment 32 between the chock rolling rails 35, 36, (35', 36').

Moreover, rails 52 are prolonged on the outside of the drum by short rails 53 mounted on an end 26 of platform 22, so as to be able to place the transfer carriage 5 in a distanced position allowing drum 3 to rotate. Rails 52 each compartment 32 of the drum can thus take up position in turn in the prolongation of rails 53 in the standby position to allow transfer means 5 to take charge of the selected rolls.

Carriage 50 is preferably fitted with a step-down motor unit 54 driving two toothed pinions 55 which each mesh respectively with a rack comprising two aligned parts, respectively a part 56 placed below fixed rails 53 and a part 57 placed below rails 52 of each compartment of the drum.

Also, transfer carriage 50 carries a supporting part 58 which can connect in movable fashion to the two rolls 4*a*, 4'*a*.

Thus, the driving in rotation of pinions 55 causes the transfer means 5 to move rails 52, 53. Other means for moving carriage 50, such as chains, screws or jacks, are also possible.

In the example shown in FIG. 1, supporting part 58 is merely used to push replacement rolls 4*a*, 4'*a* into the working position 4, 4' inside the stand. The rolls 4, 4' to be replaced must have already been withdrawn. Any suitable means can be used for this purpose.

In a particularly simple arrangement, a single storage drum 3 may be used, comprising, for example, three compartments one of which, for example compartment 32*b*, is left vacant.

In this case, to withdraw the rolls 4, 4' initially in service, the vacant Compartment 32*b* is brought into the replacement position by rotating drum 3, he rolls 4, 4' then being pushed into the vacant compartment 32*b* by means of a pushing device which can be placed on the drive side. Transfer carriage 5 could, however, also be used for this purpose by arranging supporting part 58 so that it can fix onto, in a removable way, the ends of rolls 4, 4' to be replaced.

In this way, a single storage drum containing two pairs of rolls can be used, the third compartment being used to receive the replaced rolls.

Compared to known roll replacement systems, such an arrangement using one drum is already very advantageous.

Indeed, drum 3 could initially have two pairs of rolls, chosen according to the manufacturing program, to carry out, for example, surface state changes in the case of a skin-pass rolling mill. The new rolls can be placed in alignment with the stand by simply rotating the drum, the replacement operation therefore being completed in a very short time.

During their transfer, the rolls are always perfectly held on the aligned guide rails by their chocks, which allows the replacement operation to proceed without the need to stop the feeding of the rolled strip.

Moreover, the rolls on standby are well protected inside the drum against any risk of accidental damage.

In the case of a rolling installation comprising a number of successive stands, it is advantageous for the roll replacement device 2 to move on rails in a direction parallel to the product feeding direction in order to take up position in front of one or the other of the mill stands.

The withdrawal of worn rolls and the introduction of new rolls corresponding to the continuation of the program can thus take place at the end of the line, carriage 2 then returning to take up position in front of a different stand.

In the case of a skin-pass installation often comprising a single stand, it would be sufficient to shift the roll replacement device 2 parallel to the axes of the rolls to simply clear the operator side of the stand, and this is the arrangement shown in FIG. 1. Transport device 27 is used to take carriage 2 rolling on rails 21 to a position away from stand 1.

Rolls can then be withdrawn and introduced in position from the side of the drum opposite the stand after roll replacement carriage 2 has been moved back to its distanced position. In fact, the rolls move a certain distance from the stand, which reduces the risk of damage.

Nevertheless, where layout conditions allow, it is more desirable to perform handling operations, as is customary, in a storage and maintenance zone away from the rolling mill. The entire drum has to be transported from carriage 2 to the storage zone, and inversely, by means of a handling device such as a travelling crane. The rolls are perfectly sheltered inside the drum during these operations and are not at risk of damage.

Moreover, several pairs of rolls can be moved during each handling operation, depending on to the number of compartments in the drum.

Drum handling operations are facilitated by the fact that the drum simply rests on the two pairs of rollers 24, 25 on platform 22.

In the embodiment which has just been described with reference to FIG. 1, roll replacement requires only one drum 3 containing one empty compartment and associated with one means of transfer 5 operating in both directions. It is however desirable, in order to save time, to perform both operations in a single movement of the transfer means, the rolls to be replaced being pushed by the new rolls onto an auxiliary support placed on the other side of the drum and carrying at least one compartment fitted with two pairs of guide rails placed in alignment with fixed rails 15, 15' of stand 1.

However, to increase the number of pairs of rolls kept in store and as a result reduce even further the number of handling operations required, it is particularly attractive to use, as an auxiliary support a second drum 3' identical to the first drum 3. An overall diagram of this preferred arrangement of the invention is shown in FIG. 3 and in greater detail in FIGS. 4 and 5.

Figure 4:
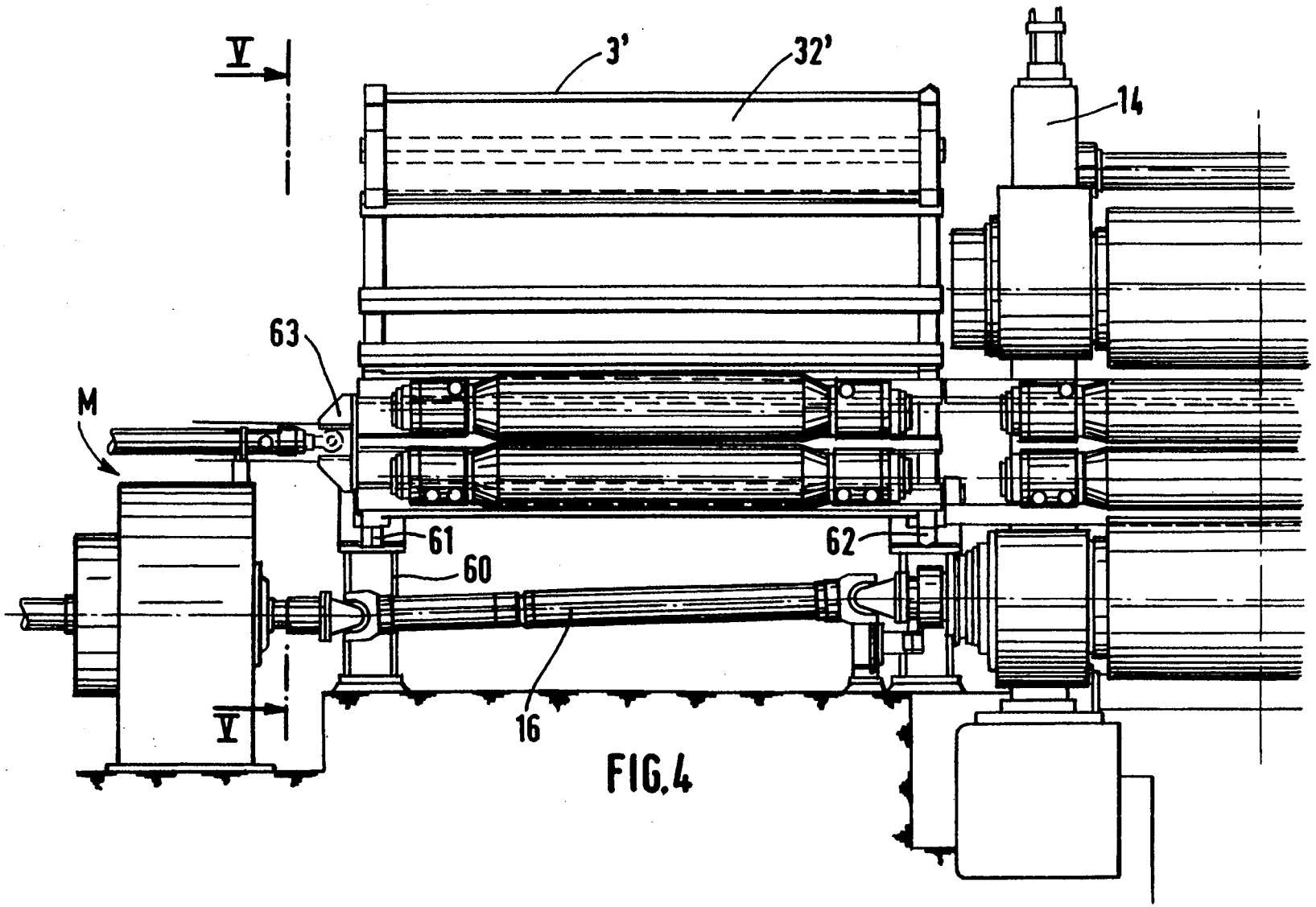
FIG. 4 is a longitudinal cross-sectional view of the second storage drum.
Figure 5:
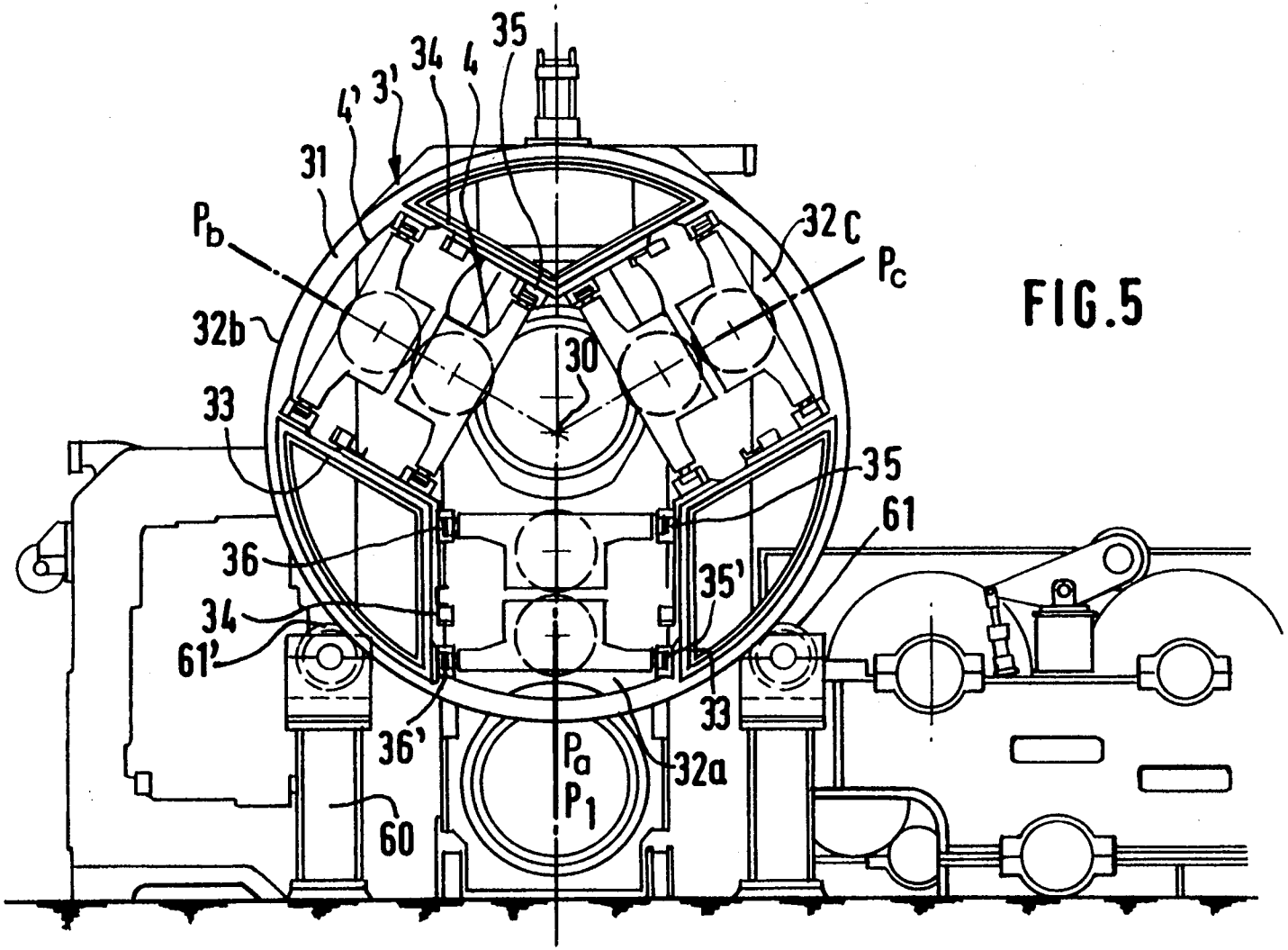
FIG. 5 is a rear elevation view along the line V—V in FIG. 4.

As can be seen in these figures, skin-pass rolling mill stand 1 is associated, with a roll replacement carriage 2 carrying a drum 3 and a second roll replacement device 6 which is shown in greater detail in longitudinal cross-section in FIG. 4 and in to transverse cross-section in FIG. 5.

As shown in all these figures, roll replacement device 6 also comprises a storage means which can be made up to a second drum 3' identical and interchangeable with drum 3.

Drum 3' is placed on two pairs of rollers 61, 61', 62, 62' mounted in rotary fashion on a fixed support 60. The level of fixed support 60 is adjusted so that each compartment 32', when brought to the lower part and in the median plane of drum 3' by rotating drum 3', is in alignment with rolls 4, 4' in the working position in stand 1.

The second drum 3' can be driven in rotation about its axis in the same way as described previously for the first drum 3 in order to precisely align each compartment 32' in turn with the live rolls.

Moreover, drum 3' is advantageously associated with a means 63 for transferring rolls into the working position in stand 1.

As described previously, drums 3 and 3', which each simply rest on two pairs of rollers, can be handled by a travelling crane.

In the case of a skin-pass rolling installation comprising a single stand, the stand can be fitted on the drive side with a fixed support 60 on which drum 3' is placed, and carriage 2 carrying drum 3 can move on rails 21 parallel to the axes of the rolls between a roll replacement position and a position away from the stand.

This is the arrangement shown in FIGS. 3, 4 and 5. It can be seen in particular that, in the case where only lower pressure roll 12' is driven in rotation, spindle 16 can pass below drum 3', rollers 61, 62 being placed at a level such that when compartments 32' of drum 3' are in their lowest position, they are in alignment with the live rolls.

It can be seen in FIGS. 4 and 5 that a central space 37 exists in the axis of drum 3', substantially at the level of the axis of upper pressure roll 12. It is therefore possible, when the two pressure rolls have to be driven, to pass a spindle through central space 37 in order to drive the upper pressure roll.

When milling only requires one pressure roll to be driven, drum 3' can be loaded and unloaded in the maintenance zone and transported by means of a travelling crane, it being possible to dismantle the upper spindle.

However, drum 3' can also remain fixed on its support 60, thus avoiding the need to transport drum 3' and, if applicable, leaving the upper spindle in place.

Figure 6:
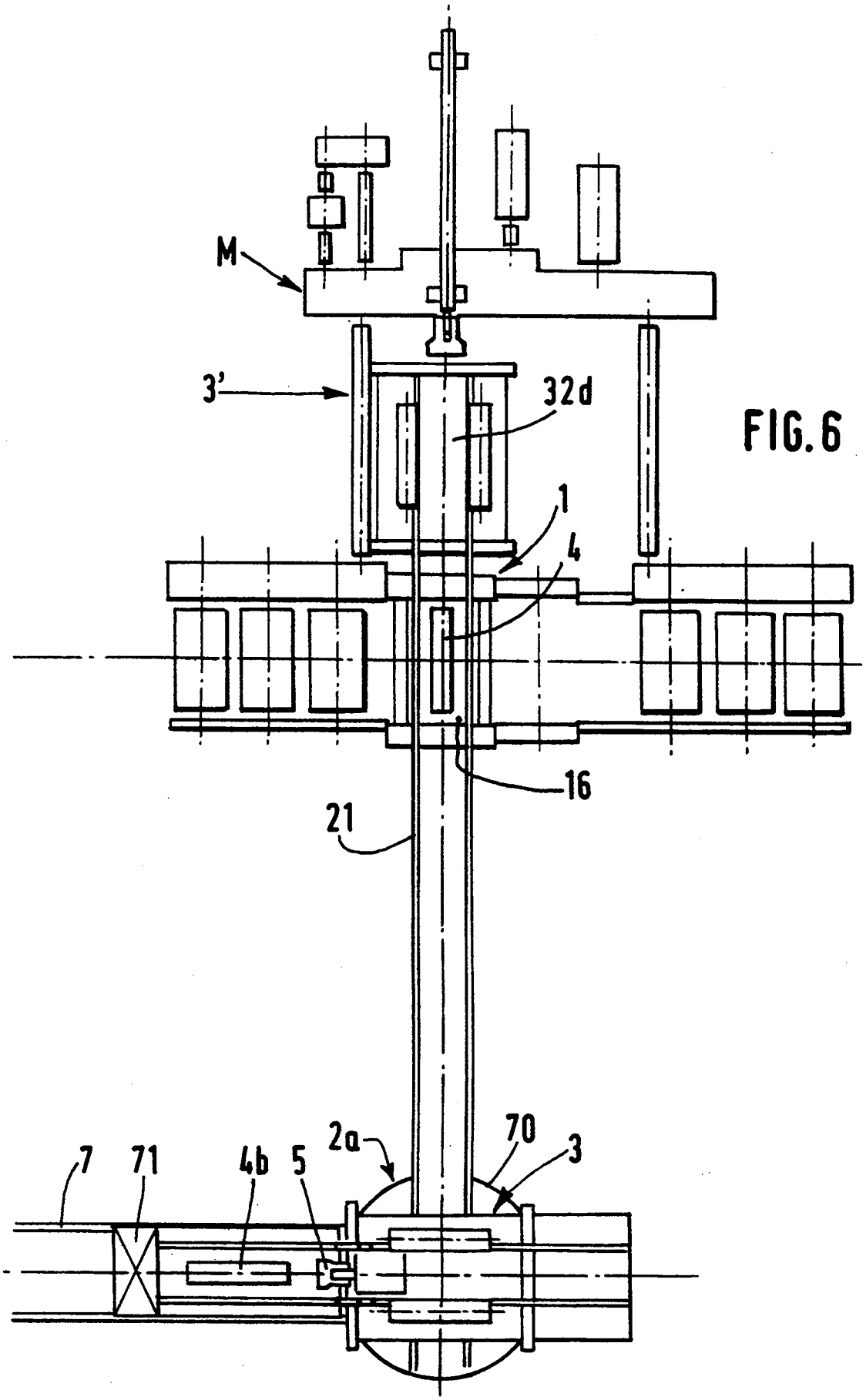
FIGS. 6, 7 and 8 schematically show the different stages in the process for replacing a pair of rolls in a two-drum installation according to FIG. 3.
Figure 7:
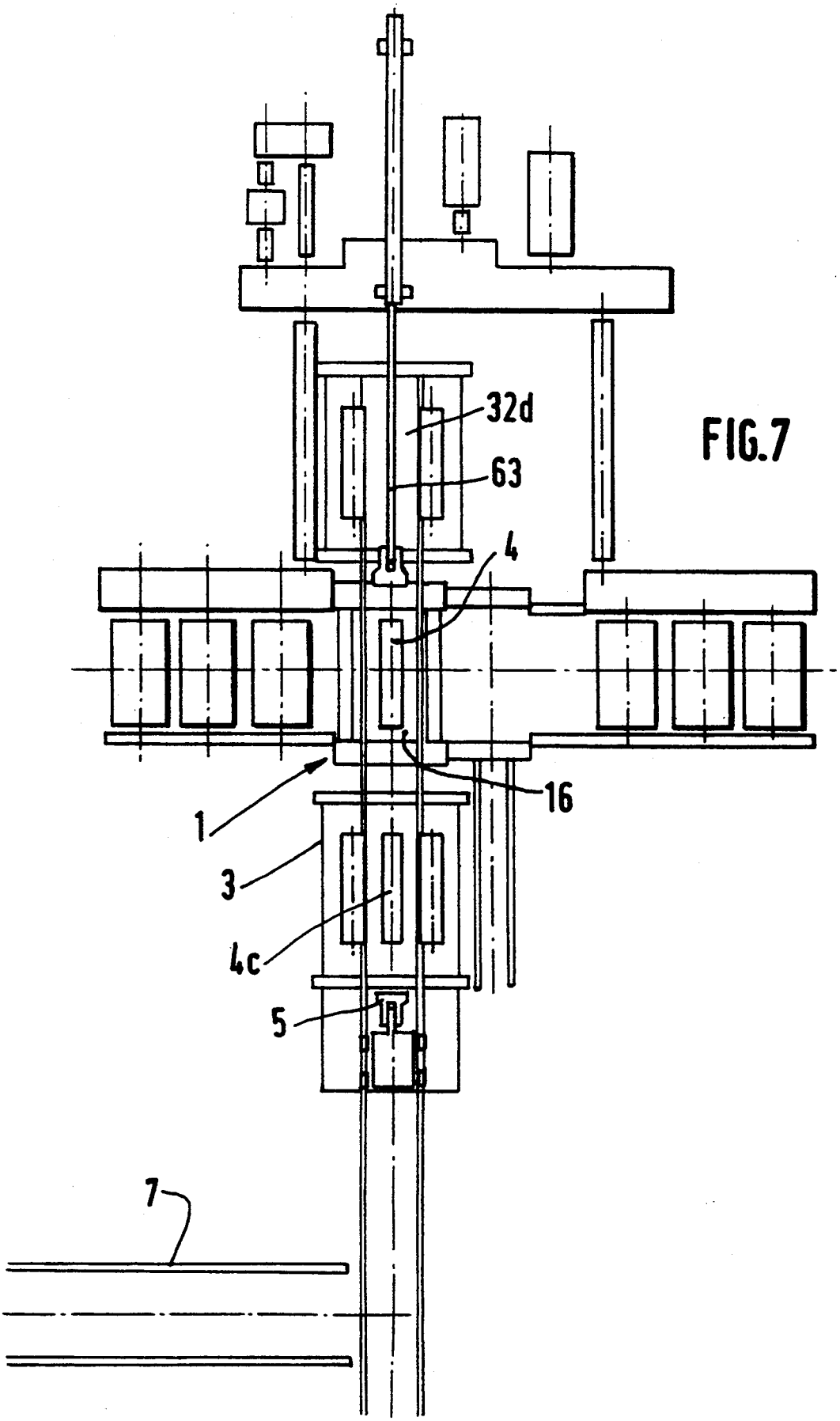
Figure 8:
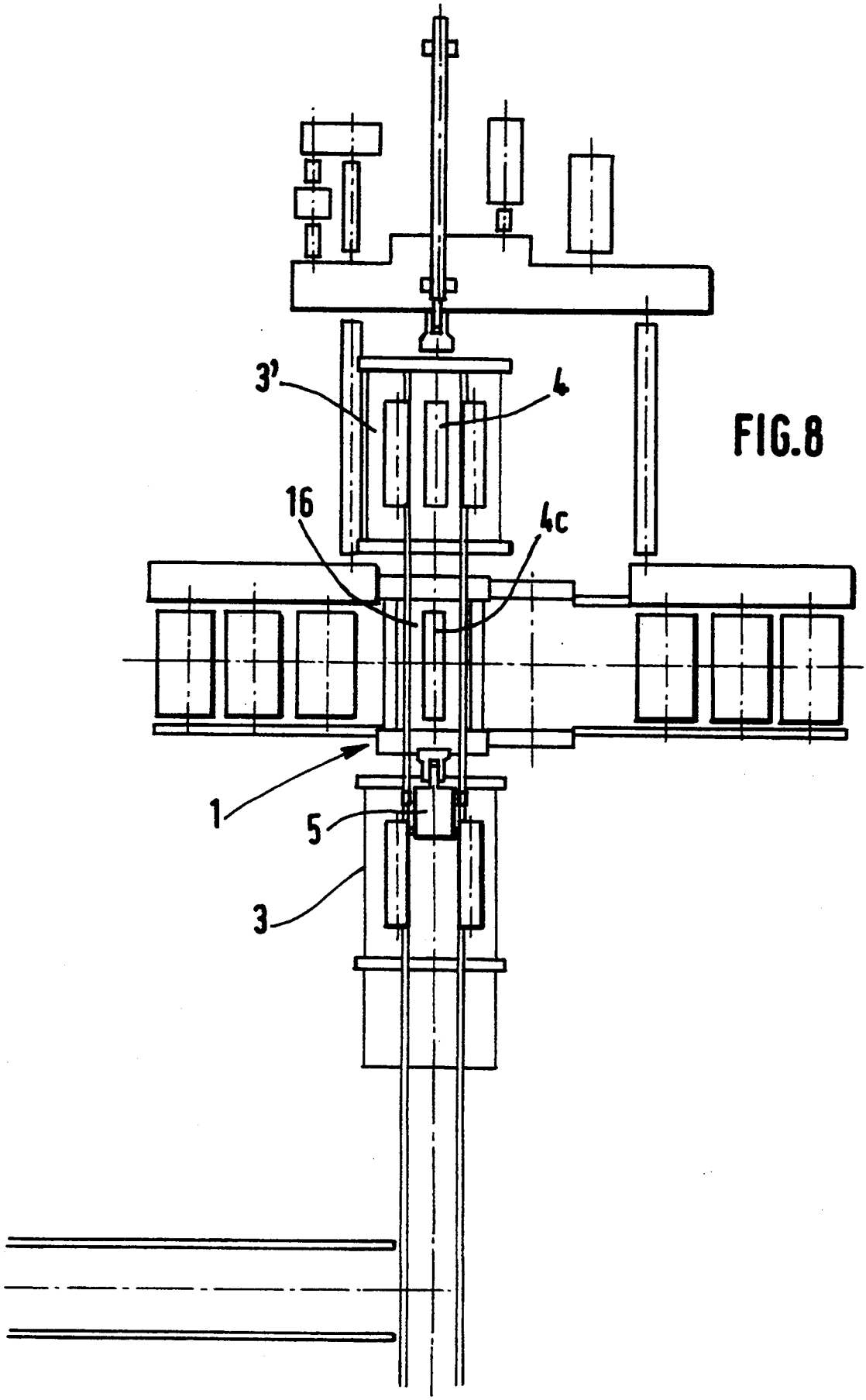

Rolls are therefore introduced and withdrawn on the operator side by passing them through the stand. To avoid overhead transportation, which could be dangerous and awkward, it is advantageous to use the to improved installation shown in FIG. 5; an operating method is shown in FIGS. 6, 7 and 8 by way of example.

These figures schematically show an above view of a skin-pass mill stand 1 associated, in a conventional manner, with tensioning devices T, T', and which is fitted with a roll replacement installation comprising two storage drums 3, 3' placed on either side of the product feed axis x—x'.

Drum 3 placed on the operator side can move as described above on rails 21 up to a distanced position 2*a*. Drum 3', placed on the side of drive means M, is fixed.

In the distanced position 2*a*, a rolling track 7 is placed parallel to the feed axis x—x'. A carriage 71 moves on rolling track 7 to bring one or more pairs of replacement rolls from the storage and maintenance zone to within the proximity of stand 1 and, if necessary, to return worn rolls to that zone.

Rolling track 7 crosses the end of rails 21 perpendicular to the rails. A turntable 70 is placed on the crossing point corresponding to the distanced position 2*a* of roll replacement carriage 2.

The roll replacement carriage 2 can thus turn 90' on turntable 70 to arrive in position 2*a* with drum 3 aligned with carriage 71 rolling on rails 7 carrying the replacement rolls.

In the example shown in FIGS. 6, 7 and 8, fixed drum 3' comprises at least one vacant compartment, the two other compartments being occupied by pairs of rolls introduced beforehand according to the manufacturing program.

With roll replacement carriage 2 located in the position shown in FIG. 6, its associated transfer means 5, or a specific transfer means associated with carriage 71, is used to introduce the pair or pairs of rolls 4*b*, 4'*b* brought by carriage 71 into the different compartments of drum 3.

Carriage 2, along with drum 3, then turns through 90' and rolls on rails 21 to the position alongside rolling mill 1, as shown in FIG. 7. Drum 3 is then pivoted about its axis to bring compartment 32 to the lower position, the latter compartment 32 containing the pair of rolls, for example 4*c*, 4′*c*, that are to be placed in position in rolling mill 1.

Second drum 3′ is also pivoted so as to bring vacant compartment 32*d* to the lower position in alignment with live rolls 4, 4′ which are in service at this time in the stand of rolling mill 1.

Transfer means 63 then locks onto the pair of rolls 4, 4′ and draws them into the vacant compartment or drum 3′ At the same time, transfer device 5 pushes the selected pair of rolls 4*c*, 4′*c* out of drum 3 into the vacated working position inside stand 1.

The configuration is now in the position shown in FIG. 8.

Such a process, which assumes the availability of a vacant compartment in the second drum 3′, can be executed whenever necessary to simply place rolls 4, 4′, initially in service at the beginning of the process, in storage for a certain period of time and later return them to service according to the program. Indeed, in this case, six pairs of rolls with different characteristics are available, one pair in service and five pairs on standby that can be placed in position very rapidly.

Conversely, if rolls 4, 4′ in service at the beginning of the process become worn or damaged, a vacant compartment must be available in the first drum 3 into which rolls 4, 4′ can be returned by means of the transfer device 5. The new rolls to be placed in position in the stand thus liberated are taken, according to the program, from one or the other of the two drums 3, 3′.

Drum 3 then moves back to position 2*a* and turns to take up the position shown in FIG. 7 coming into alignment with carriage 71. The worn rolls 4, 4′ are pushed onto carriage 71 which can then be taken back to the workshop.

Note that when the second drum 3′ is fixed, it can be loaded with rolls chosen according to the program using carriages 71 and 2 in the way that has just been described, the new rolls simply traversing working space 16 left free in stand 1.

Moreover, rolls 4, 4′ can be withdrawn from the stand and replaced by a pair of rolls from drum 3 or drum 3′ in a single operation by means of transfer device 5 or 63; the rolls to be replaced 4, 4′ are simply pushed back by replacement rolls 4*a*, 4′*a*, into the vacant compartment in the facing drum.

It can be see tidal such an installation offers many possibilities and other modes of operation using the same means can be envisaged. For example, a simplified arrangement has already been described whereby the second drum could be replaced by a simple support carrying a single compartment. This compartment can be left vacant to receive the pair of rolls removed from the mill stand, at this end a travelling crane may be used. The rolls can also be stored for a short period of time and then reintroduced into stand 1, the auxiliary support having a means 5′ for pushing the said rolls.

In particular, it may also be necessary to change the rolls on several successive stands, for example in the case of an installation comprising a pair of skin-pass stands or in a tandem rolling installation.

Roll replacement carriage 2 must therefore move parallel to the product feed direction, i.e., perpendicular to the plane of FIG. 1, so as to be able to take up position in front of one of the mill stands.

To conserve the embodiment which has just been described, it is sufficient to extend rails 7, associate each stand with rails 21 and place a turntable at each crossing point. Such an arrangement will be adopted, in particular, in the case of an installation comprising a pair of skin-pass stands.

Also, as described above, drums 3 and 3′ are interchangeable and can be loaded in the workshop with new pairs of rolls and then transported by a travelling crane which places them in position on support devices 2 and 6. Carriage 2 previously described could therefore be replaced by a fixed support, although this has the drawback of cluttering up the operator side of the stand.

In a particularly simple embodiment, a single drum could even be used placed on the drive side on a fixed support above the lower spindle. Moreover, in the drawings, the drum is placed at the level of the upper pressure roll, although in certain layouts, it would be possible to place it at the level of the lower pressure roll, the upper roll then being driven by a spindle passing above the drum.

In addition, a travelling crane or another lifting device could be used to handle the drums instead of the arrangements shown in FIGS. 6, 7 and 8. In this case, a pair of rolls 4, 4′ could easily be introduced or removed from a drum 3 (3′) in the manner shown in FIG. 3. The cylindrical envelope 31 of drum 3 (3′) can have removable sectors respectively closing off the three storage compartments 32 delimited by partitions 33, 33′. By making drum 3 turn, in the distanced position for example, compartment 32*c* containing the pair of rolls to take away, is brought to the upper position centered on the median plane. The corresponding sector 31′ is then moved away, leaving compartment 32*c* upwardly open. A lifting means 72 is used to withdraw the worn rolls 4*c* and replace them with new rolls or else to leave compartment 32*c* vacant.

It is particularly advantageous to use drums 3, 3′ to place replacement rolls in storage and withdraw worn rolls since the diameter of such a drum can be similar to the length of stand I in the product feed direction and will therefore not increase the encumbrance of the stand.

The installation has been described for the most advantageous case where both superposed live rolls are replaced simultaneously. However, the same means could be used to replace a single roll, for example, if this one roll has become damaged.

What claimed is:

1. A roll replacement installation in a rolling mill for rolling a product passing along a feed axis, said installation comprising (a) a fixed stand;

(b) at least four superposed rolls, including two live rolls placed in a working zone of said stand and at least two pressure rolls, said live rolls bearing on said pressure rolls;

(c) each live roll having two ends carried respectively by chocks each having guiding parts symmetrical with respect to a tightening plane passing through axes of said live rolls;

(d) said chocks sliding, respectively, on two pairs of fixed guide rails extending parallel to said axes of said rolls and provided on said stand on each side of said tightening plane, for removal of said live rolls by a sliding axial movement;

said installation being fitted with storage and replacement means comprising (e) at least one drum arranged on one side of said stand, said drum being mounted for rotation about a rotational axis parallel to said axes of the rolls, and positioned in said tightening plane;

(f) said drum comprising at least three compartments, each of said compartments being symmetrical with respect to a median plane passing through said rotational axis;

(g) means for controlling rotation of said drum about said rotational axis in order to successively place each compartment of said drum in front of a working zone of said stand in a roll replacement position in which the median plane of each said compartment coincides with said tightening plane;

(h) two pairs of guide rails inside each said compartment of said drum arranged symmetrically with respect to the median plane of said compartment, said rails being placed in alignment with, respectively, two pairs of fixed rails of said stand, in the roll replacement position of a corresponding compartment;

(i) one of said compartments being vacant and all others of said compartments containing, on standby, a pair of live rolls having chocks bearing, respectively, on corresponding rails of said compartment;

(j) each compartment of said drum having means for holding the pair of rolls in position inside said compartment in any angular position of said drum;

(k) at least one transfer means for transferring, by axial sliding movement, the pair of live rolls located in said stand to a withdrawn position outside said stand located in alignment with said working zone, and inversely, the pair of rolls stored in the corresponding compartment of said drum to a working zone of said stand, said compartment being brought into alignment with said working zone by rotating said drum.

2. The roll replacement installation according to claim 1, wherein said stand is associated with a first roll replacement and storage device equipped with a drum placed on the operator side of said stand, and a second roll replacement and storage device placed on an auxiliary support on the drive side of said stand and comprising at least one compartment equipped with two pairs of superposed guide rails placed, respectively, in alignment with the fixed rails of said stand, the transfer means associated with said roll replacement device simultaneously transferring replacement rolls from said drum to a working position and pushing rolls to be replaced out of said working position to said auxiliary support.

3. The roll replacement installation according to claim 2, wherein said auxiliary support is associated with a transfer means adapted for simultaneously transferring a pair of replacement rolls from said auxiliary support to said working position in said stand and pushing rolls to be replaced from said working position to an empty compartment of said drum previously placed in alignment with said working position by a corresponding rotation of said drum.

4. The roll replacement installation according to claim 3, wherein said auxiliary support is equipped with a second drum identical to a first drum of said roll replacement device, said first and second drums being placed, respectively, on each side of said working position, at least one of said drums having a vacant compartment for reception of a pair of rolls to be replaced after said pair of rolls has been withdrawn from said stand.

5. The roll replacement installation according to claim 1, wherein said drum is removably mounted on a chassis of a roll replacement device comprising a platform carrying at least two pairs of rollers spaced symmetrically with respect to each other and each side of a vertical median plane of a platform which, in the roll replacement position, coincides with a tightening plane of said stand, said drum having, on its periphery, at least two circular tracks centered on said rotational axis of said drum and respectively resting on said pairs of rollers.

6. Roll replacement installation in a rolling mill comprising:

(a) a fixed stand (1), (b) at least four superposed rolls, including two live rolls (4, 4') placed in a working zone of said stand (1) and at least two pressure rolls, said live rolls bearing on said pressure rolls;

(c) each live roll (4, 4') having two ends carried respectively by chocks (13) defining an axis of rotation, said chocks (13) each having guiding parts symmetrical with respect to a tightening plane passing through axes of said live rolls (4, 4');

(d) said chocks sliding, respectively, on two pairs of fixed guide rails (15) extending parallel to said axes of said rolls and provided on said stand on each side of said tightening plane, for removal of said live rolls by a sliding axial movement;

said installation comprising:

(e) at least line roll replacement device arranged on at least one side of said stand (1) and comprising at least two compartments, said device being mounted for rotation about an axis (30) parallel to the axes of said rolls (4, 4');

(f) means for controlling rotation of said device about said axis (30) in order to successively place each compartment **(32*a*, 32*b*) in front of a working zone of said stand (1)**;

wherein said replacement device is fitted with storage means consisting of:

(g) a drum (3) which is removably mounted on a chassis (2) comprising a platform (22) carrying at least two pairs of rollers (24) spaced symmetrically on both sides of a vertical median plane of said platform (22), said drum (3) having, on a periphery of said drum, at least two circular tracks (31) resting respectively on said at least two pairs of rollers (24), and centered on said rotational axis of said drum (3), which is so located in said median plane (P1) of said platform (22), said median plan (P1) coinciding, in a roll replacement position, with said tightening plane (P) of said stand (1);

(h) said drum (3) comprising at least two compartments **(32*a*, 32*b*)** each symmetrical with respect to a median plane (P*a*, P*b*), said median planes (P*a*, P*b*) of said at least two compartments passing through said rotational axis (30) of said drum (3) and successively coming into alignment with said median plane (P1) of said platform (22) by rotation of said drum (3);

(i) each compartment **(32*a*, 32*b*) of said drum (3) comprising two pairs of guide rails (35, 36) (35', 36')** respectively for chocks of a pair of live rolls, said two pairs of guide rails each being arranged symmetrically with respect to the median plane (P*a*, P*b*) of a corresponding compartment **(32*a*, 32*b*)**;

(j) said two pairs of guide rails (35, 36) (35', 36') being placed in each compartment (32*a*, 32*b*) in alignment with, respectively, said two pairs of fixed rails (15) of said stand (1) in roll replacement position of a corresponding compartment;

(k) each compartment (32*a*, 32*b*) of said drum (3) having means for holding a pair of live rolls in position inside said compartment in any angular position of said drum (3);

(l) at least one compartment (32*a*) of said drum (3) containing a pair of live rolls on stand-by, and at least one other compartment (32*b*) of said drum (3) being vacant;

(m) said drum (3) being associated with at least one transfer means for transferring, by a first axial sliding movement, a pair of in-service rolls (4, 4') located in said stand (1) into said vacant compartment (32*b*) of said drum (3) after aligning said drum with said working zone and, by a second axial sliding movement, said pair of stand-by rolls (4*a*, 4'*a*) from said one of said compartments to said working zone of said stand (1), after aligning said compartment (32*a*) with said working zone by rotating said device (3) about its rotational axis (30).

7. Roll replacement installation in a rolling mill comprising:

(a) a fixed stand (1) having a drive side and an operator side;

(b) at least four superposed rolls, including two live rolls (4, 4') placed in a working zone of said stand (1) and at least two pressure rolls (12, 12'), said live rolls bearing on said pressure rolls;

(c) each live roll (4, 4') having two ends carried respectively by chocks (13) defining an axis of rotation, said chocks (13) each having guiding parts symmetrical with respect to a tightening plane (P) passing through axes of said live rolls (4, 4');

(d) said chocks sliding, respectively, on two pairs of fixed guide rails (15) extending parallel to said axes of said rolls and provided on said stand on each side of said tightening plane, for removal of said live rolls (4, 4') by a sliding axial movement;

said installation comprising:

(e) at least two roll replacement devices (3, 3'), including a first replacement device (3) arranged on said operator side and comprising at least two compartments (32*a*, 32*b*), and a second replacement device (3') arranged on said drive side and comprising at least one compartment (32');

(f) each compartment (32*a*, 32*b*, 32') of said first and second replacement devices comprising two pairs of guide rails (35, 36; 35' 36') respectively for chocks of a pair of live rolls, which are placed in each compartment symmetrically with respect to a median plane of said compartment, in alignment with, respectively, said two pairs of fixed rails (15) in a roll replacement position of a corresponding compartment in front of said working zone of said stand (1);

(g) said first replacement device (3) being constituted by a drum (3) mounted on a chassis (2) for rotation about an axis (30) parallel to the axes of said rolls (4, 4'), and located in a median plane (P1) of said chassis (2) in alignment with said tightening plane of said stand (1), said drum (3) comprising at least two compartments (32*a*, 32*b*), each symmetrical with respect to a median plane (P*a*, P*b*), said median planes (P*a*, P*b*) passing through said axis (30) of rotation of said drum (3) and successively coming into alignment with said median plane of said chassis (2) by rotation of said drum (3), so as to successively place each compartment (32*a*, 32*b*) in front of said working zone of said stand (1);

(h) each compartment (32*a*, 32*b*) of said drum (3) having means for holding a pair of live rolls in position inside said compartment in any angular position of said drum (3);

(i) said second replacement device (3') being placed on an auxiliary support (60) and comprising at least one compartment (32') having a median plane in alignment with said tightening plane of said stand (1);

(j) at least one of said compartments (32*a*, 32*b*, 32') of said first and second replacement devices (3, 3') being vacant and the at least two other compartments constituting storages containing at least two pairs of live rolls stored on stand-by;

(k) at least one transfer means for transferring, by a first axial sliding movement, a pair of in-service rolls (4, 4') located in said stand (1) to a withdrawn position in the vacant compartment located in alignment with said working zone on one of said two replacement devices and for transferring, by a second axial sliding movement, one pair of replacement rolls (4*a*, 4'*a*) stored on stand-by from one of said storage compartments (32*a*) to said working zone of said stand (1), after bringing said storage compartment (32*a*) into alignment with said working zone by rotating said device (3) about said rotational axis (30).

8. Roll replacement installation according to claim 7, wherein said second replacement device (3') is constituted by a rotating drum (3') identical to said drum of said first replacement device (3) and mounted on a fixed chassis is (6).

9. Roll replacement device according to claim 7 or 8, wherein said first and second replacement devices (3, 3') are associated with a transfer means for simultaneously transferring one pair of replacement rolls from a storage compartment of one replacement device to said working zone and pushing the pair of rolls in service from said working zone to the vacant compartment of the other replacement device.

10. The roll replacement installation according to any one of claims 1, 6 and 7 wherein the means for holding a pair of rolls in position inside each compartment consist of the two pairs of guide rails, these guide rails each having a U-shaped cross-section in which the guiding parts of the chocks of the rolls are inserted with exactly the amount of play necessary to ensure sliding.

11. The roll replacement installation according to any one of claims 1, 6 and 7, wherein said transfer means are mounted on a support chassis of said drum and comprise a supporting part adapted to be rigidly locked in a removable fashion with each pair of rolls, in at least one direction of movement, and means for controlling movement of said supporting part parallel to the axes of said rolls between a first position in which the pair of rolls are taken in charge in the storage means, and a second position in which said pair of rolls are deposited in said stand, and inversely.

12. The roll replacement installation according to any one of claims 1, 6 and 7, wherein each compartment is placed, by rotating said drum, in a loading position for which the compartment centered in the vertical median plane of said drum is placed above the drum axis, and opens upwardly to allow a pair of rolls to be withdrawn and/or introduced by means of a handling means, said drum comprising movable means for closing each compartment and locking the pair of rolls in position after it has been introduced into said compartment.

13. The roll replacement installation according to any one of claims 5, 6 and 7, wherein said chassis carrying said drum is placed on an operator side and is provided on a carriage rolling on rails and associated with means for moving said carriage between a first and second roll replacement positions respectively attached to said stand and remote from said stand.

14. The roll replacement installation according to claim 13 for replacing live rolls in a rolling installation comprising several stands positioned in sequence along a feed direction of a product to be rolled, wherein the rails on which said carriage rolls extend parallel to said feed direction so that the replacement carriage can serve all of said stands.

15. The roll replacement installation according to claim 13, wherein the rolling rails of said carriage are parallel to the axes of said rolls.

16. The roll replacement installation according to claim 15, wherein a distanced position of said carriage corresponds to a crossing point where the rolling rails cross a transverse rolling track on which a loading carriage moves carrying at least one pair of replacement rolls, said crossing point consisting of a turntable on which the roll replacement carriage is placed so as to be brought into alignment with said loading carriage for transfer of replacement rolls from said loading carriage to a vacant compartment in said drum and, inversely, worn rolls from said drum to said loading carriage.

17. The installation according to claim 16 for the replacement of live rolls in a rolling installation comprising a plurality of stands arranged in sequence along a feed direction of a product to be rolled, each of said stands being associated with a pair of rolling rails on which a roll replacement carriage rolls, and said rolling track of said loading carriage extending in front of all of said stands by crossing the corresponding pairs of rails, each crossing point being equipped with a turntable.

18. The roll replacement installation according to claim 6 or 7, wherein each drum contains three compartments each having means for holding and guiding a pair of rolls, said compartments being centered on three planes passing through said rotational axis and being mutually spaced by 120°.

19. The roll replacement installation according to any one of claims 1, 6 and 8, wherein each drum comprises, between said compartments, a free axial space for passage of a means controlling the driving of an upper pressure roll when said drum is placed on the drive side of said stand.

20. Roll replacement installation according to claim 7 or 8, wherein each drum (3, 3') is removably mounted on a chassis (2, 6) comprising a platform (22) carrying at least two pairs of rollers (24, 25; 61, 62) spaced symmetrically on both sides of a vertical median plane of said platform (22, 60), said drum (3, 3') having, on its periphery, at least two circular tracks (31) resting respectively on said at least two pairs of rollers (24, 25) (61, 62), and centered on said rotational axis (30) of said drum (3, 3'), which is so located in the median plane of said platform (22, 60), said median plane coinciding, in a roll replacement position, with said tightening plane of said stand (1).

21. Roll replacement installation according to claim 7 or 8, for replacing live rolls in a rolling installation comprising several stands arranged in sequence along a feed direction of a product to be rolled, said installation comprising:

(a) a plurality of pairs of rails (21), each associated with one of said stands (1) and extending parallel to the axes of the rolls on an operator side of said stands (1);

(b) a rolling track (7), parallel to said feed direction of said product and crossing said pairs of rails (21) in a distanced position (2*a*) remote from said stands (1), a turntable (70) being placed on each crossing point between said rolling track (7) and each pair of rails (21), said rolling track (7) extending to a storage and maintenance zone;

(c) a first replacement carriage (2) forming a chassis (2) carrying said first replacement drum (3), said carriage (2) rolling along any one of said pairs of rails (21) between a first replacement position attached to a corresponding stand (1) and said distanced position (2*a*) on a corresponding turntable (70);

(d) a second carriage (71) comprising means for carrying at least one pair of replacement rolls and moving along said rolling track (7) between said storage and maintenance zone and any one of said turntables (70);

(e) said first replacement carriage (2) coming into alignment with said second carriage (71) after turning 90° on the corresponding turntable (70) for transferring a pair of rolls (4*b*, 4' b) brought by said second carriage (71) into a vacant compartment of said drum (3) and for transferring worn rolls from said drum (3) onto said second carriage (71).

* * * * *